US010941018B2

(12) United States Patent
Mahoney

(10) Patent No.: US 10,941,018 B2
(45) Date of Patent: Mar. 9, 2021

(54) ELEVATOR AUTO-POSITIONING FOR VALIDATING MAINTENANCE

(71) Applicant: Otis Elevator Company, Farmington, CT (US)

(72) Inventor: Sally Day Mahoney, New Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 543 days.

(21) Appl. No.: 15/861,783

(22) Filed: Jan. 4, 2018

(65) Prior Publication Data

US 2019/0202660 A1 Jul. 4, 2019

(51) Int. Cl.
*B66B 5/00* (2006.01)
*B66B 1/34* (2006.01)

(52) U.S. Cl.
CPC ..... *B66B 5/0025* (2013.01); *B66B 5/005* (2013.01); *B66B 5/0018* (2013.01); *B66B 5/0087* (2013.01); *B66B 1/3423* (2013.01)

(58) Field of Classification Search
CPC ..... B66B 5/0025; B66B 5/0018; B66B 5/005; B66B 3/002; B66B 1/466
USPC ..... 187/393
See application file for complete search history.

(56) References Cited

U.S. PATENT DOCUMENTS 4,203,360 A 5/1980 Madwed
4,373,573 A 2/1983 Madwed
4,645,411 A 2/1987 Madwed
5,547,038 A 8/1996 Madwed
6,109,379 A 8/2000 Madwed
6,478,099 B1 11/2002 Madwed
6,863,161 B2 3/2005 Mearns et al.
7,002,462 B2 2/2006 Welch
7,448,473 B2 11/2008 Lindberg et al.
7,832,638 B2 11/2010 Wetzel et al.
8,418,815 B2 4/2013 Encinas et al.
8,540,057 B2 9/2013 Schuster et al.
8,660,565 B2 2/2014 Hall
8,896,216 B2 * 11/2014 Lee ..... H05B 45/44 315/153

(Continued)

FOREIGN PATENT DOCUMENTS

CN 101537953 A 9/2009
CN 201494977 U 7/2010

(Continued)

OTHER PUBLICATIONS

European Search Report for EP 18248187.9 dated May 27, 2019; 9 pages.

(Continued)

*Primary Examiner* — David S Warren
(74) *Attorney, Agent, or Firm* — Cantor Colburn LLP

(57) ABSTRACT

An elevator system is described. Aspects include an elevator shaft, an elevator car, and at least one camera, wherein the camera is operated by a controller. The controller configured to receive a maintenance request associated with the elevator system. The maintenance request is analyzed to determine an operational mode for the elevator car. The operational mode is enabled for the elevator car. The camera captures media associated with the elevator system responsive to enabling the operational mode for the elevator car.

18 Claims, 4 Drawing Sheets

(56) References Cited

U.S. PATENT DOCUMENTS

| | | | | |
|---|---|---|---|---|
| 9,580,276 | B2 | 2/2017 | Toutaoui | |
| 9,665,932 | B2 | 5/2017 | Lauffer et al. | |
| 9,667,929 | B2 * | 5/2017 | Yang | H04N 9/3182 |
| 9,734,003 | B2 | 8/2017 | Sekine et al. | |
| 9,734,693 | B2 | 8/2017 | McKinley et al. | |
| 9,743,490 | B1 * | 8/2017 | Li | H05B 47/11 |
| 10,176,385 | B2 * | 1/2019 | Brunn | G06K 9/00791 |
| 10,504,400 | B2 * | 12/2019 | Wang | G09G 3/2003 |
| 2004/0094366 | A1 * | 5/2004 | Weinberger | B66B 5/0025 187/247 |
| 2007/0107992 | A1 * | 5/2007 | Fujita | B66B 1/34 187/391 |
| 2008/0024409 | A1 * | 1/2008 | Tomizawa | G09G 3/3648 345/88 |
| 2008/0117020 | A1 * | 5/2008 | Martin | G06T 7/269 340/5.7 |
| 2008/0198117 | A1 * | 8/2008 | Kumakura | G09G 3/3648 345/89 |
| 2008/0283342 | A1 * | 11/2008 | Deplazes | B66B 5/0025 187/391 |
| 2008/0317382 | A1 * | 12/2008 | Franz | G06T 3/0081 382/294 |
| 2009/0040196 | A1 * | 2/2009 | Duckstein | B60K 37/06 345/204 |
| 2011/0067958 | A1 * | 3/2011 | Schuster | B66B 5/0006 187/393 |
| 2013/0140134 | A1 * | 6/2013 | Senger | B66B 29/005 198/322 |
| 2016/0107861 | A1 | 4/2016 | Thebeau et al. | |
| 2016/0269701 | A1 * | 9/2016 | Guo | H04N 9/3155 |
| 2017/0015521 | A1 * | 1/2017 | Toutaoui | B66B 5/0025 |
| 2017/0197807 | A1 * | 7/2017 | Noda | G06K 9/00335 |
| 2017/0355554 | A1 | 12/2017 | Eleid et al. | |
| 2018/0158434 | A1 * | 6/2018 | Bian | G09G 5/10 |
| 2018/0238815 | A1 * | 8/2018 | Mupende | G01N 21/952 |
| 2018/0273346 | A1 * | 9/2018 | Hwang | B66B 5/0012 |
| 2019/0112152 | A1 * | 4/2019 | Kujala | G01N 21/8851 |
| 2019/0177122 | A1 * | 6/2019 | Mahoney | B66B 3/002 |
| 2019/0202659 | A1 | 7/2019 | Sudi et al. | |
| 2019/0202660 | A1 * | 7/2019 | Mahoney | B66B 5/005 |
| 2019/0237008 | A1 * | 8/2019 | Ho | G09G 3/3233 |
| 2019/0322489 | A1 | 10/2019 | Watabe et al. | |
| 2020/0011674 | A1 * | 1/2020 | Fanselow | G01C 21/206 |
| 2020/0102188 | A1 * | 4/2020 | Holey | B66B 5/0025 |
| 2020/0118259 | A1 * | 4/2020 | Mahadevappa | G06T 7/001 |
| 2020/0126497 | A1 * | 4/2020 | Wang | G09G 3/3607 |

FOREIGN PATENT DOCUMENTS

| | | | |
|---|---|---|---|
| CN | 202124380 | U | 1/2012 |
| CN | 102616617 | A | 8/2012 |
| CN | 103738804 | A | 4/2014 |
| CN | 203673303 | U | 6/2014 |
| CN | 203682801 | U | 7/2014 |
| CN | 102616613 | B | 2/2015 |
| CN | 103482442 | B | 6/2016 |
| CN | 105731209 | A | 8/2016 |
| CN | 205527123 | U | 8/2016 |
| CN | 106219367 | A | 1/2017 |
| CN | 106494959 | A | 3/2017 |
| CN | 104444674 | B | 5/2017 |
| CN | 106672721 | A | 5/2017 |
| CN | 105129559 | B | 6/2017 |
| CN | 206336868 | U | 7/2017 |
| EP | 1178001 | A1 | 2/2002 |
| EP | 3124418 | A1 | 8/2017 |
| JP | 108169679 | A | 7/1996 |
| JP | H1149445 | A | 2/1999 |
| JP | 2003192248 | A | 7/2003 |
| JP | 2007276941 | A | 10/2007 |
| JP | 2009214998 | A | 9/2009 |
| WO | 2003066497 | A1 | 8/2003 |
| WO | 2006048497 | A1 | 5/2006 |
| WO | 2006077654 | A1 | 7/2006 |
| WO | 2009051587 | A1 | 4/2009 |
| WO | 2010092619 | A1 | 8/2010 |
| WO | 2016120373 | A1 | 8/2016 |
| WO | 2017037240 | A1 | 4/2017 |

OTHER PUBLICATIONS

European Search Report for EP 19150380.4 dated Jun. 6, 2019; 9 pages.

* cited by examiner

ELEVATOR AUTO-POSITIONING FOR VALIDATING MAINTENANCE

BACKGROUND

The subject matter disclosed herein generally relates to elevator systems and, more particularly, to elevator auto-positioning for performing maintenance.

For inspection of an elevator system, a mechanic typically physically inspects the top and the bottom of an elevator car as well as other locations within the elevator hoistway to inspect various components of the elevator system. Due to the confined nature of an elevator system, physical inspection of components of an elevator car can be difficult.

BRIEF DESCRIPTION

According to one embodiment, an elevator system is provided. The elevator system includes an elevator shaft, an elevator car, and at least one camera, wherein the camera is operated by a controller. The controller configured to receive a maintenance request associated with the elevator system. The maintenance request is analyzed to determine an operational mode for the elevator car. The operational mode is enabled for the elevator car. The camera captures media associated with the elevator system responsive to enabling the operational mode for the elevator car.

In addition to one or more of the features described above, or as an alternative, further embodiments of the elevator system may include that the controller is further configured to transmit, by a transceiver, the media captured from the camera.

In addition to one or more of the features described above, or as an alternative, further embodiments of the elevator system may include one or more sensors associated with the elevator system and wherein the controller is further configured to transmit sensor data, by the transceiver, to a maintenance server, wherein the maintenance server determines the maintenance request based at least part on the sensor data.

In addition to one or more of the features described above, or as an alternative, further embodiments of the elevator system may include that the maintenance server analyzes the sensor data to determine anomalous sensor data, the maintenance server determines a root cause of the anomalous sensor data based at least in part on a root cause analysis of the anomalous sensor data, and the maintenance request comprises the root cause.

In addition to one or more of the features described above, or as an alternative, further embodiments of the elevator system may include that the analyzing the maintenance request to determine an operational mode for the elevator car includes analyzing the root cause to identify one or more components in the elevator system associated with the root cause. A location of the one or more components in the elevator system is determined and at least one camera position, one elevator car location, and a velocity of the elevator car are determined for the operational mode.

In addition to one or more of the features described above, or as an alternative, further embodiments of the elevator system may include that the media captured from the camera comprises at least one of an image and a video.

In addition to one or more of the features described above, or as an alternative, further embodiments of the elevator system may include that the media captured from the camera is transmitted to a user device.

In addition to one or more of the features described above, or as an alternative, further embodiments of the elevator system may include that the controller is further configured to receive camera adjustment data from a user.

In addition to one or more of the features described above, or as an alternative, further embodiments of the elevator system may include that the media captured from the camera is transmitted to a maintenance server.

In addition to one or more of the features described above, or as an alternative, further embodiments of the elevator system may include that the maintenance server analyzes the media to determine the maintenance request based at least in part on the analysis of the media.

According to one embodiment, a method is provided. The method includes receiving, by a processor, a maintenance request associated with the elevator system, wherein the elevator system comprises at least one elevator car, at least one camera, and an elevator shaft. The maintenance request is analyzed to determine an operational mode for an elevator car in the elevator system. The operational mode for the elevator car is automatically enabled and media associated with the elevator system is captured from a camera responsive to enabling the operational mode for the elevator car.

In addition to one or more of the features described above, or as an alternative, further embodiments of the method may include transmitting, by a transceiver, the media captured from the camera.

In addition to one or more of the features described above, or as an alternative, further embodiments of the method may include that obtaining sensor data from one or more sensors associated with the elevator system and transmitting the sensor data, by the transceiver, to a maintenance server, wherein the maintenance server determines the maintenance request based at least part on the sensor data.

In addition to one or more of the features described above, or as an alternative, further embodiments of the method may include that the maintenance server analyzes the sensor data to determine anomalous sensor data, the maintenance server determines a root cause of the anomalous sensor data based at least in part on a root cause analysis of the anomalous sensor data, and the maintenance request comprises the root cause.

In addition to one or more of the features described above, or as an alternative, further embodiments of the method may include that the analyzing the maintenance request to determine an operational mode for the elevator car includes analyzing the root cause to identify one or more components in the elevator system associated with the root cause. A location of the one or more components in the elevator system is determined and at least one camera position, one elevator car location, and a velocity of the elevator car are determined for the operational mode.

In addition to one or more of the features described above, or as an alternative, further embodiments of the method may include that the media captured from the camera comprises at least one of an image and a video.

In addition to one or more of the features described above, or as an alternative, further embodiments of the method may include that the media captured from the camera is transmitted to a user device.

In addition to one or more of the features described above, or as an alternative, further embodiments of the method may include receiving camera adjustment data from a user.

In addition to one or more of the features described above, or as an alternative, further embodiments of the method may include that the media captured from the camera is transmitted to a maintenance server.

In addition to one or more of the features described above, or as an alternative, further embodiments of the method may include that the maintenance server analyzes the media to determine the maintenance request associated with the elevator system based at least in part on the analysis of the media.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
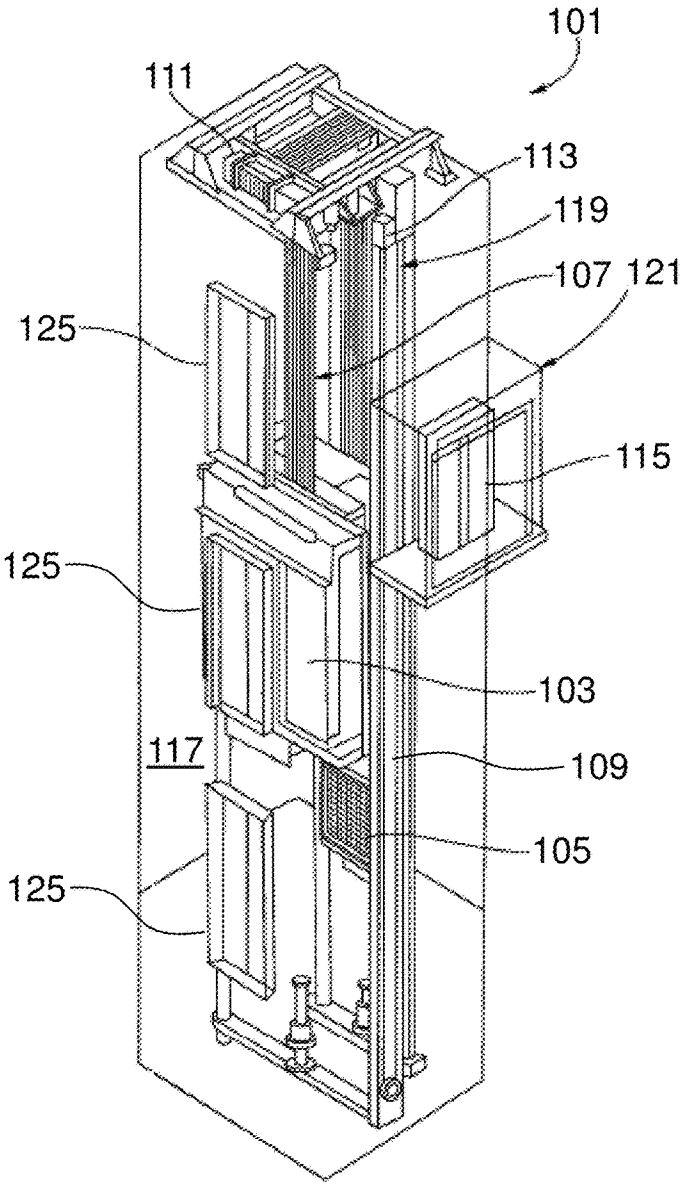
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
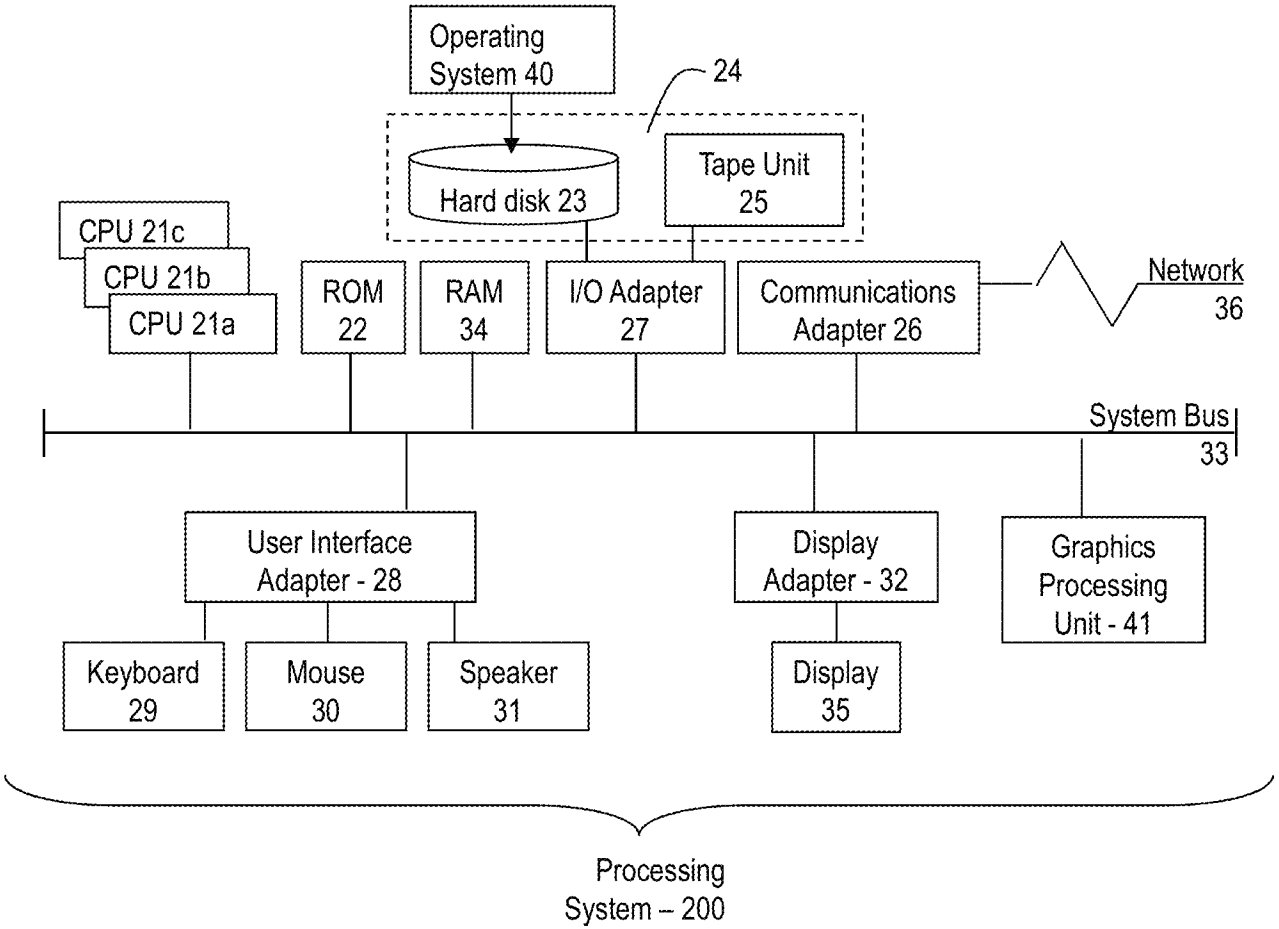
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 and various other components via a system bus 33. Read only memory (ROM) 22 is coupled to the system bus 33 and may include a basic input/output system (BIOS), which controls certain basic functions of system 300.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes. In one or more embodiments, any embedded computing platform can be utilized.

Turning now to an overview of technologies that are more specifically relevant to aspects of the disclosure, sensors and software in elevator systems are used to identify equipment degradation, adjustment issues and abnormal sounds and vibration. The issues may be identified through simple logic or through data analytics algorithms like condition based maintenance (CBM). CBM is maintenance when a need arises. This type of maintenance is performed after one or more indicators shows that equipment is going to fail or that equipment performance is deteriorating. CBM can be used to prioritize and optimize maintenance resources.

The identified issues from a data analytics algorithm can be dispatched to an elevator mechanic with a specific issue to address or maintenance task to perform. Root cause or prediction for some issues may be identified with a high confidence value. However, in some cases the root cause is not known or the analytics has identified a possible root cause with a low confidence value. In this case, the mechanic will be scheduled to visit the unit and be instructed to check certain components and equipment on the elevator. It is desired to have a way to automatically gather additional information to determine a root cause of the issue, or to validate or invalidate a potential root cause that has a low confidence rating from the data analytics.

Turning now to an overview of the aspects of the disclosure, one or more embodiments address the above-described shortcomings of the prior art by providing elevator auto-positioning for validating maintenance. Aspects include utilizing an elevator controller in the elevator system to move or position an elevator car on command, a camera mounted to view specified elevator equipment, the elevator controller that can control the camera and send images or video to a cloud computing network ("cloud"), and a cloud application to store and analyze or display the images. In one embodiment, the camera and elevator control may be performed by a separate controller such as a mobile device, remote server or computer. According to one or more embodiments of the disclosure, a local, mobile or cloud based application can send a request for an image or video of elevator equipment located at a specified position in an elevator system. For example, when a command to take a video is received, the request can also include the direction and speed to move an elevator car within the elevator system. During the elevator idle time, the elevator controller can move the elevator car to the position specified. The elevator controller can utilize one or more sensors to detect when the elevator car is in the specified position. Once in the specified position, the elevator controller can send a command to a camera. The command can include an adjustment to the position, zoom, orientation, and the like, of the camera. The cameras can be adjustable to pan, zoom, and focus on multiple locations and elevator components. Also, the command can direct the camera to capture one or more images or video of the specified equipment. In the case of capturing video while the elevator car is in motion, the elevator controller can command the elevator car to move at a specified speed (or range of speeds or varying speeds) and direction to allow for one or more cameras to capture video or multiple images. Once the video or images are captured by the controller, the controller can send the video or image data, via a transceiver or other electronic communication device, to a cloud computing server for verification of the equipment by a technician or through the use of analytics. The images or videos can be viewed by accessing the cloud computing server. In one or more embodiments, a maintenance technician can access the server using a user devices such as a computer, tablet, phone, or the like. In one or more embodiments, the images and videos can be stored local to the elevator system and accessed by a maintenance technician through a user interface local to the elevator system or accessed remotely by a user device through a network. The images or videos can be viewed or analyzed to validate or invalidate the maintenance issue.

In one or more embodiments, the maintenance issue can be identified by logic or data analytics algorithms such as condition based maintenance. The analysis of the maintenance issue can be used to identify a root cause of an unknown or anomalous sensor reading such as a sound, vibration, and/or abnormality. In one or more embodiments, the images and/or video can be transmitted to a smart device, such as a smart phone or tablet, of an elevator mechanic or technician for review on the smart device. In one or more embodiments, the elevator car can be moved to any position within the elevator shaft. The elevator car can have cameras mounted at different locations either on the elevator car or in the elevator shaft positioned to view equipment located on the elevator car or in the elevator shaft. The cameras can also be adjusted to capture multiple views of the elevator equipment. For example, a camera can be mounted on an elevator car to view the rails in an elevator system and the elevator controller can move the elevator car into position to view portions of a suspected rail bracket along the elevator rail. Another example is mounting a camera to a fixed location in the elevator system to view an elevator shaft allowing the elevator controller to move an elevator car to get a view of a specific section of elevator ropes. Or, in yet another example, an elevator controller can cycle the elevator car to particular locations to capture images or video of components on the elevator car, such as the doors, that are identified by analytics.

Figure 3:
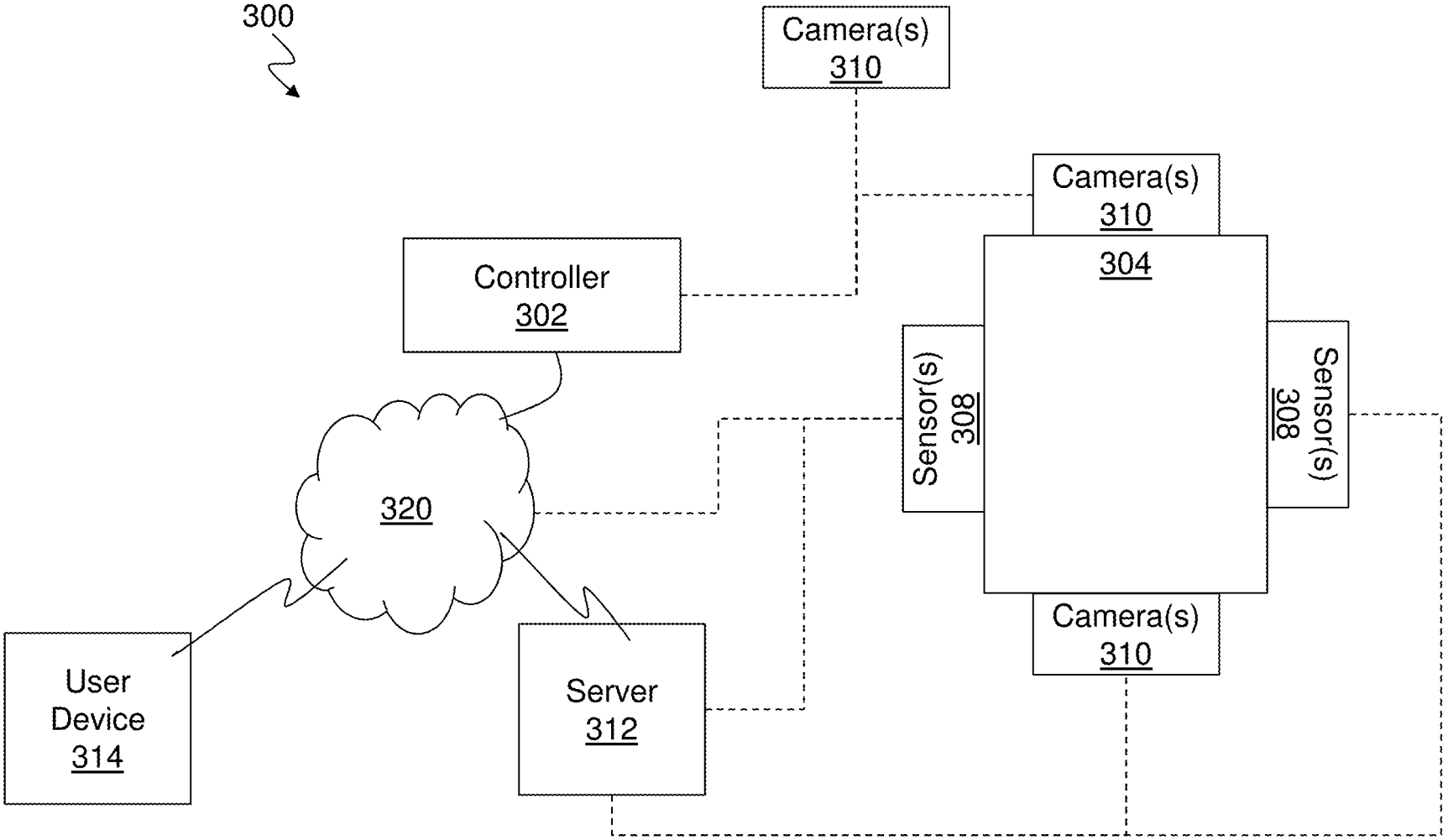
FIG. 3 depicts a block diagram of a system for inspecting an elevator system according to one or more embodiments of the disclosure.

Turning now to a more detailed description of aspects of the present disclosure, FIG. 3 depicts a system 300 for inspecting an elevator system according to one or more embodiments. The system 300 includes a controller 302, an elevator car 304, one or more sensor(s) 308, one or more camera(s) 310, a server 312, and a network 320. In some embodiments, the system 300 includes a user device 314. In one or more embodiments, the elevator car 304 is part of an elevator system, such as the elevator system 101 with elevator car 103 depicted in FIG. 1. In one or more embodiments, the controller 302 can include more than one controller (e.g., microcontroller circuit) that can operate the elevator car 103, cameras 310, sensors 308, or any combination of components of the system 300. Each individual component can have a separate controller utilized to perform some or all the functionality of the component. For example, an elevator controller can operate the elevator car 304, while a camera controller can operate the cameras 310.

In one or more embodiments, the controller 302 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein. For example, the network 320 can be a cloud network.

In one or more embodiments, the controller 302 is operable to control the elevator car 304 and maneuver the elevator car 304 within an elevator shaft. In addition, the controller 302 is operable to control the cameras 310 and capture images and video from each of the cameras 310 located on or around the elevator car 304. The media (e.g., images and video) captured from the cameras 310 can be transmitted to the controller 302 and stored in the server 312. In some embodiments, the media captured from the cameras 310 can be transmitted to a user device 314 via the network 320. The user device 314 can include a device carried by a user, such as a smart phone, PDA, tablet, smartwatch, smart glasses, laptop, etc. The cameras 310 can be mounted in an elevator system at locations such as, for example, the top of the elevator shaft, the bottom of the elevator shaft, the top of an elevator car 304, the bottom of the elevator car 304, a machine room, or any other location in the elevator system, including within the elevator car 304.

In one or more embodiments, the cameras 310 can be any type of camera that can be used to generate video and/or still frame images. The cameras 310 can capture any type of video images such as, for example, infrared images and the like. The cameras 310 can be wired or wireless cameras that can connect to the controller 302 through a wired or wireless network connection. The cameras 310 mentioned herein are only examples of suitable camera types and are not intended to suggest any limitation as to the scope of use or functionality of the cameras.

In one or more embodiments, the sensors 308 can be any type of sensor including but not limited to sensors operable to detect sound, vibrations, and/or any type of abnormality in the system 300. When an abnormality is detected by a sensor 308, the sensor 308 can transmit an indication of the abnormality to the server 312 for analysis. The server 312 can utilize any type of analytics or logic to perform a root cause analysis to determine the root cause of the abnormal sensor reading. A root cause can be determined within a confidence level (e.g., confidence interval) and based on this confidence level, an action can be taken by the system to either validate or invalidate the root cause analysis. For example, if a sensor 308 detects an anomalous reading and transmit this reading to the server 312, the server 312 can perform the root cause analysis to determine that there is a potential rail issue between floor 2 and floor 4 in an elevator system. The server 312 can transmit a signal to the controller 302 to place the elevator car 304 in a specific operational mode to attempt to validate or invalidate the potential issue. In this case, the operation mode includes moving the elevator car 304 from floor 2 to floor 4 at half the normal speed. In the one or more embodiments, the operational mode can include an indication of specific locations on or near the elevator car 304 for inspection as well as speed and direction of the elevator car 304. In this example, the cameras 310 can be adjusted to view portions of the elevator rail at or near where the anomalous reading was taken by a sensor 308. The controller 302, based on the operational mode, can command the elevator car 304 to move from floor 2 to floor 4 at half speed while the camera(s) 310 are adjusted to capture images and videos of specific locations. The captured images and videos are stored locally in the controller 302 or in the server 312 for further analysis by data analytics or by an elevator mechanic. In addition, the cameras can be adjusted during the operational mode by an elevator mechanic utilizing a user device 314 to zoom, pan, and focus on specific components in the elevator system. In one or more embodiments, the cameras are operable to pan, zoom, adjust angles, and otherwise maneuver to view multiple locations on or around the elevator car 304. In one or more embodiments, the captured images and videos can be stored locally in the controller and uploaded to a server 312 when a mechanic arrives at the elevator system 300.

In one or more embodiments, after analysis of the captured images or video, the server 312 can notify a mechanic to perform maintenance on the elevator car based on data analytics of the captured images or video. Based on the root cause analysis, the mechanic can be directed to specific locations in the elevator system for maintenance work. In one or more embodiments, the images or video can be sent directly to a user device of the elevator mechanic.

In one or more embodiments, the root cause analysis can be performed by obtaining stored images or video of elevator components for the elevator car 304 or elevator system that have been indicated as being in good operating condition by a mechanic. These images and/or video can be utilized as referenced images and compared to captured media during an operational mode for the elevator car 304 to determine if a maintenance issue is present in the elevator system. For example, the reference images may be obtained while a mechanic is on site working on the elevator car 304 and has deemed that all components of the car 304 are operating within normal tolerances. The controller 302 can capture new images based on a request from the server to investigate anomalous sensor 308 readings. These new images can be compared against the reference images to validate or invalidate a root cause analysis. Validating the root cause analysis can cause the server to notify a mechanic to perform maintenance on the elevator system. In one or more embodiments, a comparison score can be obtained based on the changes between the images. This may be performed by comparing pixel values of elevator components in the new image and the reference image, or by any other known image comparison tool. A difference in pixel value for one component in the new image and the reference image indicates a change between the new image and the reference image. The absolute values of all the pixel differences between new image and the reference image may then be summed to generate a comparison score. The pixel comparisons may be made, for example, based on change in color, change in brightness, etc. Comparing pixel values is merely exemplary and not intended to limit the application, uses, and/or technical scope for image or video analytics, which can be embodied utilizing various techniques. The pixel comparison is a non-limiting example presented for illustrative and explanatory purposes.

In one or more embodiments, any of the analytics described herein can be performed on the server 312 and/or a user device 312 including but not limited to the root cause analysis.

In one or more embodiments, if the comparison score exceeds a threshold value, the controller 302 can generate an alert and send the alert to the user device 314. The threshold value can be adjusted by the user. Multiple threshold values can be set to determine the type of alert sent to the user. For example, exceeding a larger threshold value may generate an alert sent more frequently or sent to multiple user devices 314 to amplify the severity of the change to the component image. In one or more embodiments, the threshold value can be a number, percentage, range, or any other type of threshold. For example, a comparison score exceeding 75 could indicate a need for a significant alert being sent to one or more mechanics. A comparison score between the ranges of 25 to 50 can generate an alert that is of a lower priority.

Figure 4:
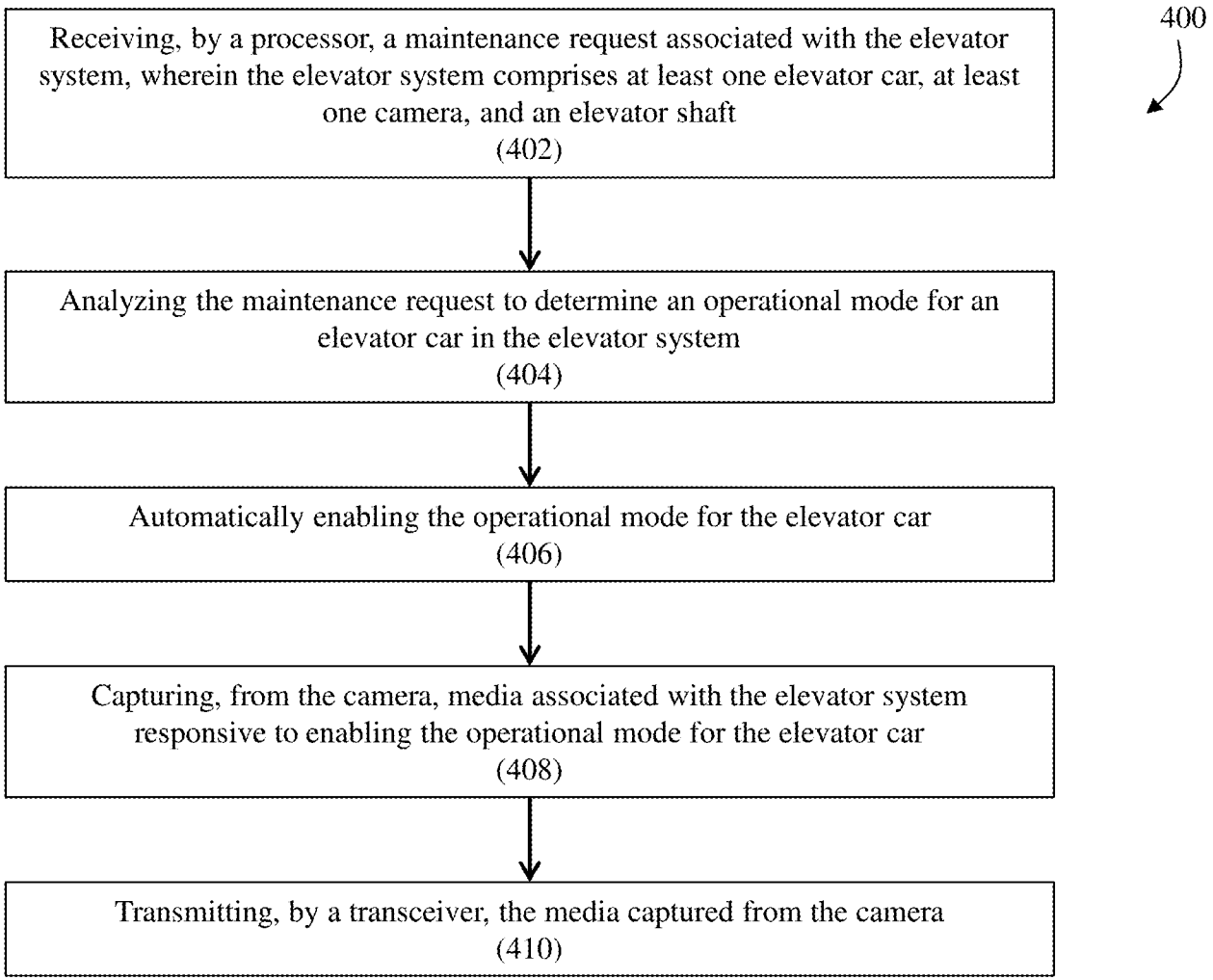
FIG. 4 depicts a flow diagram of a method for inspecting an elevator system according to one or more embodiments of the disclosure.

FIG. 4 depicts a flow diagram of a method for inspecting an elevator system according to one or more embodiments. The method 400 includes receiving, by a processor, a maintenance request associated with the elevator system, wherein the elevator system comprises at least one elevator car, at least one camera, and an elevator shaft, as shown in block 402. At block 404, the method 400 includes analyzing the maintenance request to determine an operational mode for an elevator car in the elevator system. The method 400, at block 406, includes automatically enabling the operational mode for the elevator car. At block 408, the method 400 includes capturing, from the camera, media associated with the elevator system responsive to enabling the operational mode for the elevator car. And at block 410, the method 400 includes transmitting, by a transceiver, the media captured from the camera.

Additional processes may also be included. It should be understood that the processes depicted in FIG. 4 represent illustrations and that other processes may be added or existing processes may be removed, modified, or rearranged without departing from the scope and spirit of the present disclosure A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:
an elevator shaft;
an elevator car; and
at least one camera, wherein the camera is operated by a controller, the controller configured to:
receive a maintenance request associated with the elevator system;
analyze the maintenance request to determine an operational mode for the elevator car;
enable the operational mode for the elevator car;
capture, from the camera, media associated with the elevator system responsive to enabling the operational mode for the elevator car; and
receive camera adjustment data from a user.

2. The elevator system of claim 1, wherein the controller is further configured to:
transmit, by a transceiver, the media captured from the camera.

3. The elevator system of claim 2, wherein the media captured from the camera is transmitted to a user device.

4. The elevator system of claim 2, wherein the media captured from the camera is transmitted to a maintenance server.

5. The elevator system of claim 4, wherein the maintenance server analyzes the media to determine the maintenance request based at least in part on the analysis of the media.

6. The elevator system of claim 1, further comprising:
one or more sensors associated with the elevator system; and
wherein the controller is further configured to:
transmit sensor data, by the transceiver, to a maintenance server, wherein the maintenance server determines the maintenance request based at least part on the sensor data.

7. The elevator system of claim 6, wherein the analyzing the maintenance request to determine an operational mode for the elevator car comprises:
analyzing the root cause to identify one or more components in the elevator system associated with the root cause;
determining a location of the one or more components in the elevator system; and
determining at least one camera position, at least one elevator car location, and a velocity of the elevator car for the operational mode.

8. The elevator system of claim 1, wherein the maintenance server analyzes the sensor data to determine anomalous sensor data;
wherein the maintenance server determines a root cause of the anomalous sensor data based at least in part on a root cause analysis of the anomalous sensor data; and
wherein the maintenance request comprises the root cause.

9. The elevator system of claim 1, wherein the media captured from the camera comprises at least one of an image and a video.

10. A computer-implemented method for inspecting an elevator system, the method comprising:

receiving, by a processor, a maintenance request associated with the elevator system, wherein the elevator system comprises at least one elevator car, at least one camera, and an elevator shaft;

analyzing the maintenance request to determine an operational mode for an elevator car in the elevator system;

automatically enabling the operational mode for the elevator car;

capturing, from the camera, media associated with the elevator system responsive to enabling the operational mode for the elevator car; and receiving camera adjustment data from a user.

11. The computer-implemented method of claim 10, further comprising:

transmitting, by a transceiver, the media captured from the camera.

12. The computer-implemented method of claim 11 wherein the media captured from the camera is transmitted to a maintenance server.

13. The computer-implemented method of claim 12, wherein the maintenance server analyzes the media to determine the maintenance request associated with the elevator system based at least in part on the analysis of the media.

14. The computer-implemented method of claim 10, further comprising:

obtaining sensor data from one or more sensors associated with the elevator system; and transmitting the sensor data, by the transceiver, to a maintenance server, wherein the maintenance server determines the maintenance request based at least part on the sensor data.

15. The computer-implemented method of claim 14, wherein the maintenance server analyzes the sensor data to determine anomalous sensor data;

wherein the maintenance server determines a root cause of the anomalous sensor data based at least in part on a root cause analysis of the anomalous sensor data; and wherein the maintenance request comprises the root cause.

16. The computer-implemented method of claim 15, wherein the analyzing the maintenance request to determine an operational mode for the elevator car comprises:

analyzing the root cause to identify one or more components in the elevator system associated with the root cause;

determining a location of the one or more components in the elevator system; and determining at least one camera position, at least one elevator car location, and a velocity of the elevator car for the operational mode.

17. The computer-implemented method of claim 10, wherein the media captured from the camera comprises at least one of an image and a video.

18. The computer-implemented method of claim 10, wherein the media captured from the camera is transmitted to a user device.

* * * * *